US007808353B1

(12) United States Patent
Eskridge et al.

(10) Patent No.: US 7,808,353 B1
(45) Date of Patent: Oct. 5, 2010

(54) COIL SYSTEM FOR PLASMOID THRUSTER

(75) Inventors: Richard H. Eskridge, Joppa, AL (US); Michael H. Lee, Huntsville, AL (US); Adam K. Martin, Huntsville, AL (US); Peter J. Fimognari, Monson, MA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 1064 days.

(21) Appl. No.: 11/513,433

(22) Filed: Aug. 23, 2006

(51) Int. Cl.

| | |
|---|---|
| ***H01F 27/28*** | (2006.01) |
| ***H01F 21/04*** | (2006.01) |
| ***H01F 21/02*** | (2006.01) |
| ***F03H 1/00*** | (2006.01) |
| ***B63H 11/00*** | (2006.01) |
| ***H05B 31/26*** | (2006.01) |
| ***H01K 1/04*** | (2006.01) |
| ***H01J 1/15*** | (2006.01) |

(52) U.S. Cl. ..... 336/170; 336/127; 336/147; 336/222; 336/227; 336/231; 60/202; 60/203.1; 60/204; 315/111.41; 313/346 R; 313/341

(58) Field of Classification Search ..... None
See application file for complete search history.

(56) References Cited

U.S. PATENT DOCUMENTS

| | | | | |
|---|---|---|---|---|
| 3,039,014 | A | 6/1962 | Chang | |
| 3,174,278 | A * | 3/1965 | Barger et al. | 60/202 |
| 3,290,541 | A | 12/1966 | Hertz | |
| 3,329,864 | A | 7/1967 | Michel et al. | |
| 3,370,198 | A | 2/1968 | Rogers et al. | |
| 4,068,147 | A | 1/1978 | Wells | |
| 4,267,488 | A | 5/1981 | Wells | |
| 4,663,932 | A | 5/1987 | Cox | |

(Continued)

FOREIGN PATENT DOCUMENTS

| | | |
|---|---|---|
| RU | 2162958 C2 | 2/2001 |

(Continued)

OTHER PUBLICATIONS

Richard Eskridge et al., "A Plasmoid Thruster for Space Propulsion," 39th AIAA/ASME/SAE/ASEE Joint Propulsion Conference & Exhibit (AIAA-2003-4992), ed., American Institute of Aeronautics and Astronautics (Huntsville, AL), p. 1-9, (Jul. 20, 2003).

(Continued)

*Primary Examiner*—Elvin G Enad
*Assistant Examiner*—Mangtin Lian
(74) *Attorney, Agent, or Firm*—James J. McGroary; Peter J. Van Bergen

(57) ABSTRACT

A coil system for a plasmoid thruster includes a bias coil, a drive coil and field coils. The bias and drive coils are interleaved with one another as they are helically wound about a conical region. A first field coil defines a first passage at one end of the conical region, and is connected in series with the bias coil. A second field coil defines a second passage at an opposing end of the conical region, and is connected in series with the bias coil.

24 Claims, 3 Drawing Sheets

U.S. PATENT DOCUMENTS

| | | | | |
|---|---|---|---|---|
| 5,170,623 | A * | 12/1992 | Dailey et al. | 60/202 |
| 5,339,623 | A | 8/1994 | Smith | |
| 5,357,747 | A * | 10/1994 | Myers et al. | 60/203.1 |
| 6,334,302 | B1 | 1/2002 | Chang-Diaz | |
| 6,378,290 | B1 * | 4/2002 | Killinger et al. | 60/202 |
| 6,396,213 | B1 | 5/2002 | Koloc | |
| 6,777,862 | B2 | 8/2004 | Fisch et al. | |
| 7,400,096 | B1 * | 7/2008 | Foster et al. | 315/111.41 |
| 2005/0116652 | A1 | 6/2005 | McVey et al. | |
| 2006/0042224 | A1 | 3/2006 | Shiao et al. | |

FOREIGN PATENT DOCUMENTS

| | | |
|---|---|---|
| WO | WO 80/00045 | 1/1980 |
| WO | WO 2005/029927 A2 | 3/2005 |

OTHER PUBLICATIONS

Robert F. Bourque et al., "Time-Dependent Analysis of the Pulsed Plasmoid Electric Thruster," AIAA/NASA/OAI Conf on Advanced SEI Technologies (AIAA-91-3614), American Institute of Aeronautics and Astronautics Inc. (Cleveland, OH), p. 1-8, (Sep. 4, 1991).

J.T. Slough, "Propagating Magnetic Wave Plasma Accelerator (PMWAC) for Deep Space Exploration," Phase I—Final Report for NASA Institute of Advanced Concepts Grant, Math Sciences North West (Bellevue, WA), p. 1-31.

R.H. Eskridge, P.J.Fimognari, A.K. Martin, M.H. Lee, "Design and Construction of the PT-1 Prototype Plasmoid Thruster," Space Technology and Applications International Forum STAIF 2006, American Institute of Physics, (p. 474-483), (Feb. 15, 2006).

* cited by examiner

COIL SYSTEM FOR PLASMOID THRUSTER

ORIGIN OF THE INVENTION

The invention was made in part by employees of the United States Government and may be manufactured and used by or for the Government for governmental purposes without the payment of any royalties.

BACKGROUND OF THE INVENTION

1. Field of the Invention

Generally, this invention relates to plasma thrusters. More specifically, the invention is an arrangement of driven coils that constitute a plasmoid thruster, a new type of plasma thruster.

2. Description of the Related Art

Plasma propulsion devices show great promise in terms of providing long duration operation for space travel to our solar system's outer planets. One unique type of plasma propulsion device known as a plasmoid thruster produces thrust by expelling plasmas with embedded magnetic fields at high velocities. Several existing plasma thruster designs require the use of electrodes to form plasma jets. However, such electrodes are subject to wear and loss of alignment, and also present a source of contamination in a spacecraft environment. In addition to the disadvantages presented by electrode-based systems, conventional plasma thrusters typically utilize easily ionized noble gases such as xenon, which are rare and expensive.

SUMMARY OF THE INVENTION

Accordingly it is an object of the present invention to provide an electrical system that can be used to produce a plasma jet in a plasmoid thruster.

Another object of the present invention is to provide an electrodeless electrical system for a plasmoid thruster.

Still another object of the present invention is to provide an electrical system for a plasmoid thruster that can be used to generate a plasma jet using a variety of readily accessible and storable gases.

Other objects and advantages of the present invention will become more obvious hereinafter in the specification and drawings.

In accordance with the present invention, a coil system for a plasmoid thruster includes a bias coil, a drive coil and field coils. The bias coil is defined by a first plurality of conductors positioned parallel to one another and helically wound about a conical region. The first conductors are connected to one another in a parallel configuration. The drive coil is defined by a second plurality of conductors positioned parallel to one another, interleaved with the first conductors, and helically wound about the conical region. The second conductors are connected to one another in a parallel configuration. A first field coil defines a first passage at one end of the conical region, and is connected in series with the bias coil. A second field coil defines a second passage at an opposing end of the conical region, and is connected in series with the bias coil.

BRIEF DESCRIPTION OF THE DRAWING(S)

Other objects, features and advantages of the present invention will become apparent upon reference to the following description of the preferred embodiments and to the drawings, wherein corresponding reference characters indicate corresponding parts throughout the several views of the drawings and wherein:

FIGS. 1A-1D schematically depict the general operating principles of a plasmoid thruster;

DESCRIPTION OF THE PREFERRED EMBODIMENT(S)

Figure 1A:
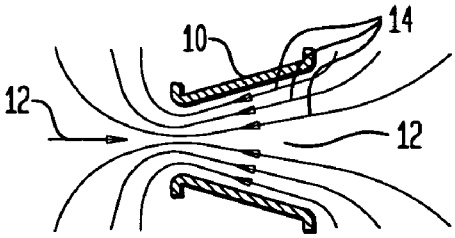
Figure 1B:
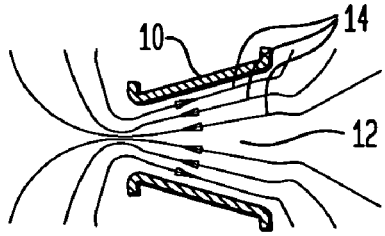
Figure 1C:
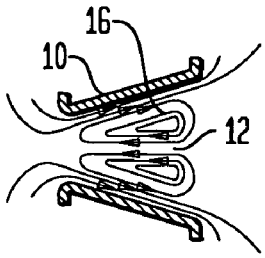
Figure 1D:
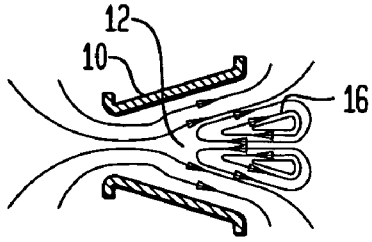

Prior to describing the present invention, the basic operational concepts of a plasmoid thruster will be described with the aid of FIGS. 1A-1D. In each of these figures, a conically-shaped current-carrying coil is referenced by numeral 10. When a gas (referenced by arrow 12 outside of coil 10 and generally by numeral 12 within coil 10) is injected into coil 10 and a current is applied to coil 10, a magnetic field (referenced by lines 14) develops as shown in FIG. 1A. If the gas is ionized during or after the establishment of this field, the gas becomes a conductive plasma and the magnetic field becomes "frozen" in the plasma. If the field increases at a very rapid rate (or if an external ionization field is applied), the gas will ionize. The current in coil 10 is adjusted to rapidly reverse magnetic field 14 as illustrated in FIG. 1B. Then, as shown in FIG. 1C, the field (lines) frozen inside the plasma sever and reconnect to form a self-contained plasma structure or plasmoid 16. Since plasmoid 16 repels any external magnetic field, it can be rapidly ejected from coil 10 in the direction of the weakest applied field as illustrated in FIG. 1D. The rapid ejection of plasmoid 16 generates thrust.

Figure 2:
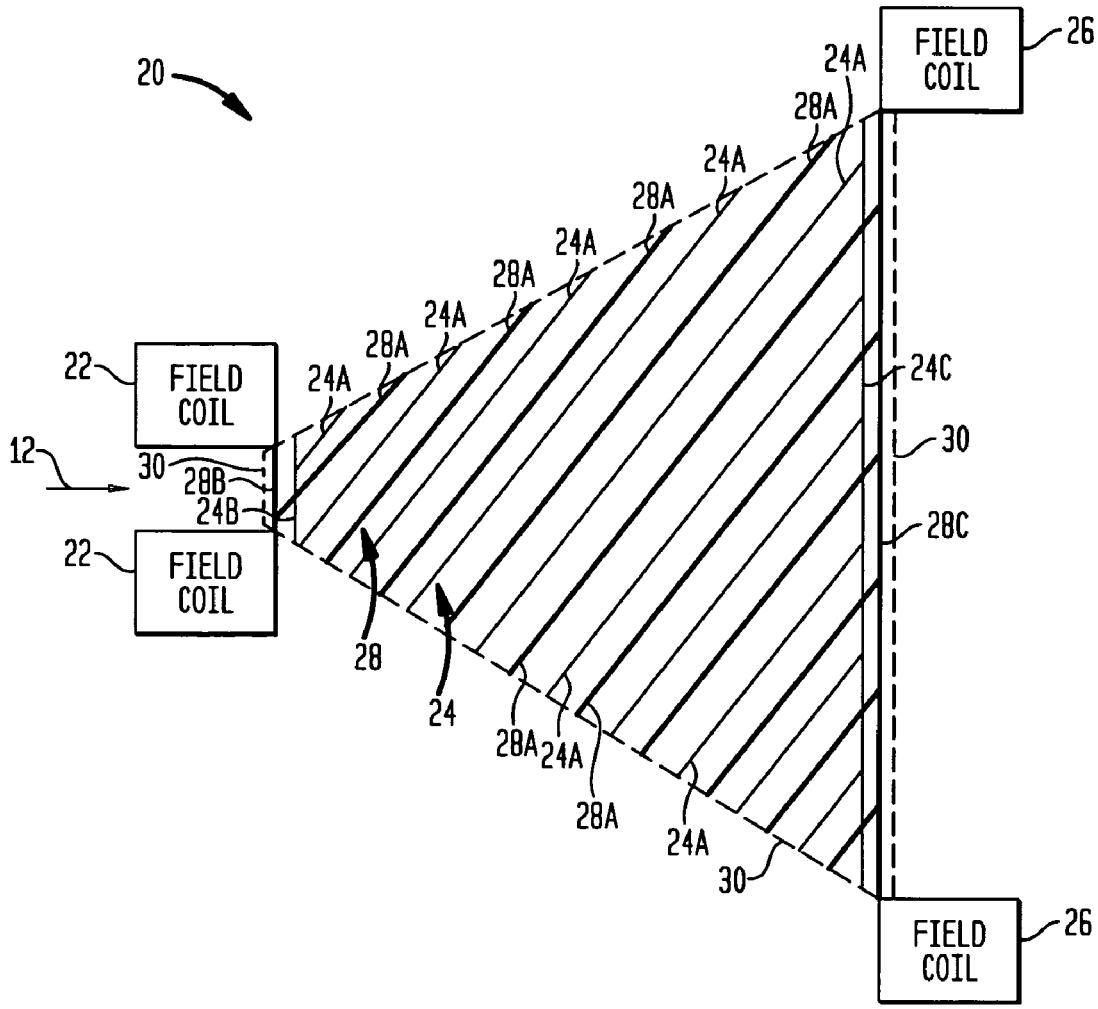
FIG. 2 is a side schematic view of a coil system for use in a plasmoid thruster in accordance with an embodiment of the present invention.

The present invention is an electrodeless coil system for a plasmoid thruster. The most elemental form of the present invention is illustrated in FIG. 2 and is referenced generally by numeral 20. Coil system 20 includes coils that will be used to generate (i) a bias field that produces a magnetic field in a plasma, and (ii) a drive field that generates and expels a plasmoid to produce thrust. In general, the coils that form part of a bias field generating circuit are a (fore) field coil 22, a bias coil 24 represented by thin solid lines, and another (aft) field coil 26. More specifically, field coils 22 and 26 are coaxially-aligned conductive coils through which a plasma (gas) 12 can flow.

Figure 3:
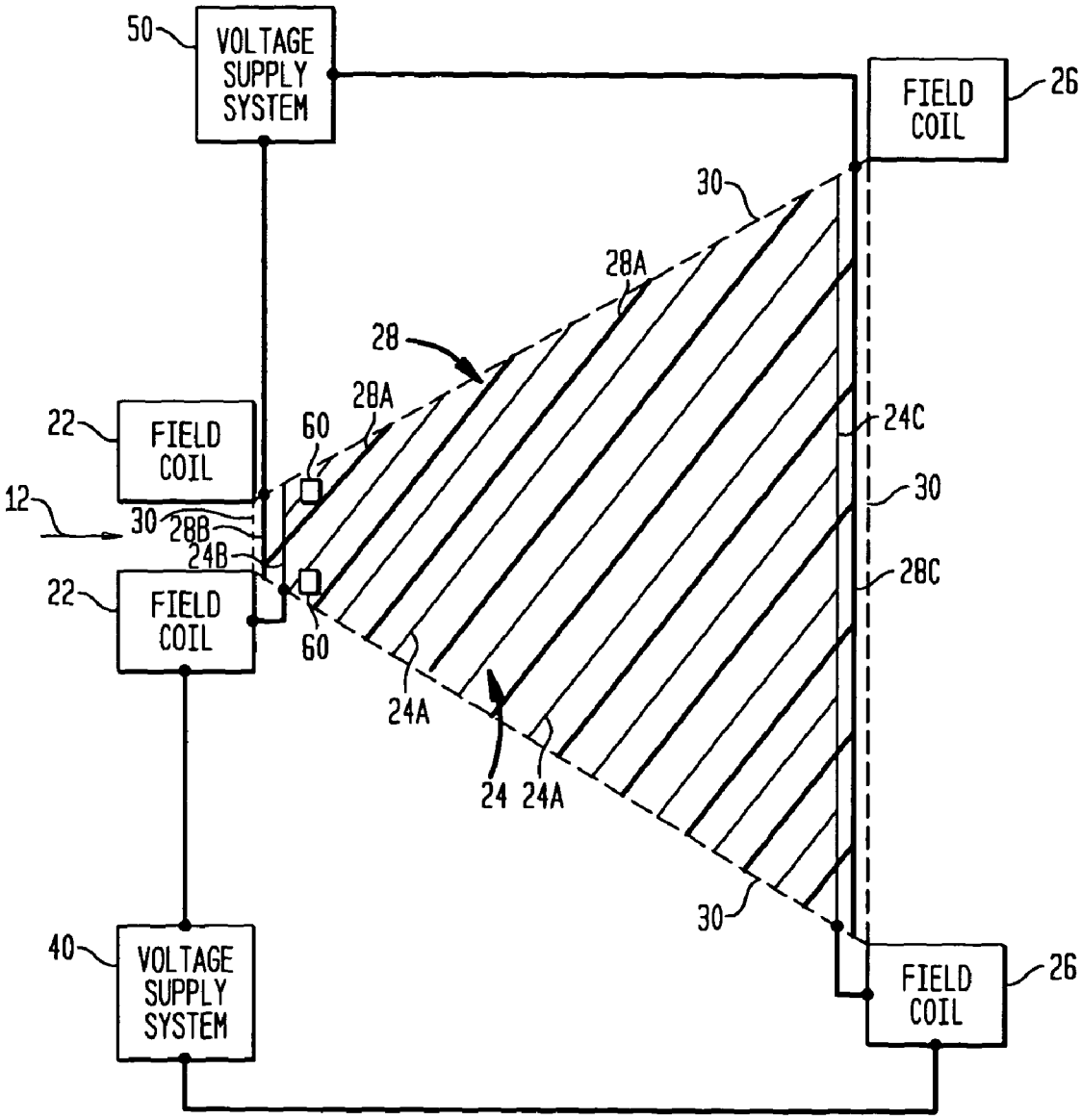
FIG. 3 is a side schematic of the coil system having independent voltage supplies included in the system's respective biasing and drive circuits.

Between field coils 22 and 26 are bias coil 24 and a drive coil 28 that is represented by heavy solid lines. Bias coil 24 is constructed with a number of electrical conductors 24A (i.e., more than 1) that are parallel to one another. Conductors 24A wrap helically about a conical region defined by dashed lines 30. The number of turns that each conductors 24A makes about conical region 30 is a design parameter and is not a limitation of the present invention. Each of conductors 24A terminates at an axial end of conical region where conductors 24A are electrically connected in parallel to one another. For example, the ends of conductors 24A at one axial end of conical region 30 can be electrically connected to each other using a first electric connector 24B while the ends of conductors 24A at the other end of conical region 30 can be electrically connected to each other using a second electrical connector 24C. In the present invention, field coil 22, bias coil 24 and field coil 26 are electrically connected to one another in a series fashion as illustrated in FIG. 3.

Interleaved with bias coil 24 is drive coil 28. More specifically, drive coil 28 is constructed with a number of electrical conductors 28A (i.e., more than 1 and equal in number to conductors 24A) that are parallel to one another. Conductors 28A also wrap helically about conical region 30 while being interleaved with conductors 24A with all conductors 24A and 28A being parallel to one another. Typically, the spacing between adjacent conductors 24A and 28A is identical. The number of turns that each of conductors 28A makes about conical region 30 will be identical to the number of turns for conductors 24A.

Similar to bias coil 24, each of conductors 28A terminates at an axial end of conical region 30 with conductors 28A being electrically connected in parallel to one another. For example, the ends of each of conductors 28A at one axial end of conical region 30 can be electrically connected to each other using a first electrical connector 28B. The ends of conductors 28A at the other end of conical region 30 can be electrically connected to each other using a second electrical connector 28C.

When using the coil system of the present invention for a plasmoid thruster, the biasing portion of the coil system must have a voltage applied thereto that is independent of the voltage applied to the drive portion of the coil system. By way of example, FIG. 3 illustrates two separate voltage supply systems 40 and 50 coupled to coil system 20. Voltage supply system 40 is coupled in a series with field coil 22, bias coil 24 and field coil 26 to define one complete circuit, whereas voltage supply system 50 is coupled in series with drive coil 28 to define a second complete circuit. As would be understood in the art, each of voltage supply systems 40 and 50 are capacitive electric discharge systems that can (and typically will) include a voltage source as well as supporting circuit elements (e.g., capacitors, solid-state switches, resistors, diodes, etc.).

To form a plasmoid and produce thrust using the coil system of the present invention, the following general procedure is followed. A gas 12 is injected through field coil 22 and into the volume defined by conical region 30. Voltage supply system 40 is operated to slowly increase the voltage applied to the series combination of field coil 22, bias coil 24 and field coil 26. As a result, a bias field is introduced into gas 12 within conical region 30. As the bias field is introduced, a preionizer coil 60 may need to be provided and excited by a capacitive electric discharge system (not shown) at a high AC frequency (e.g., typically greater than 4 Mhz). If present, preionizer coil 60 is operated to ionize the gas to produce a conductive plasma. That is, if preionizer coil 60 is needed, it is energized to slightly preionize gas 12 shortly after gas 12 is injected into conical region 30. When the gas becomes a conductive plasma, the bias field lines are "frozen" into the plasma and tend to remain with the plasma when it translates rapidly. If the bias field is designed to be applied at a rapid enough rate, then the gas will auto-ionize without the use of preionizer coil 60. However, since it is not always possible to design a system that can produce such a rapid change in magnetic flux, the use of a separate preionizer coil 60 may be required. Such construction and use of preionizer coil 60 is known to those skilled in the art.

After a selected delay, drive coil 28 is energized by voltage supply system 50 to produce a drive field in the plasma (generated from gas 12) that is stronger than and opposite to the afore-mentioned bias field. The two fields attract/repel each other with the stronger drive field causing a plasmoid to form in conical region 30. The voltage supplied by system 50 is such that the stronger drive field compresses the plasmoid and expels it at high velocity out of the divergent axial end of conical region 30.

Figure 4:
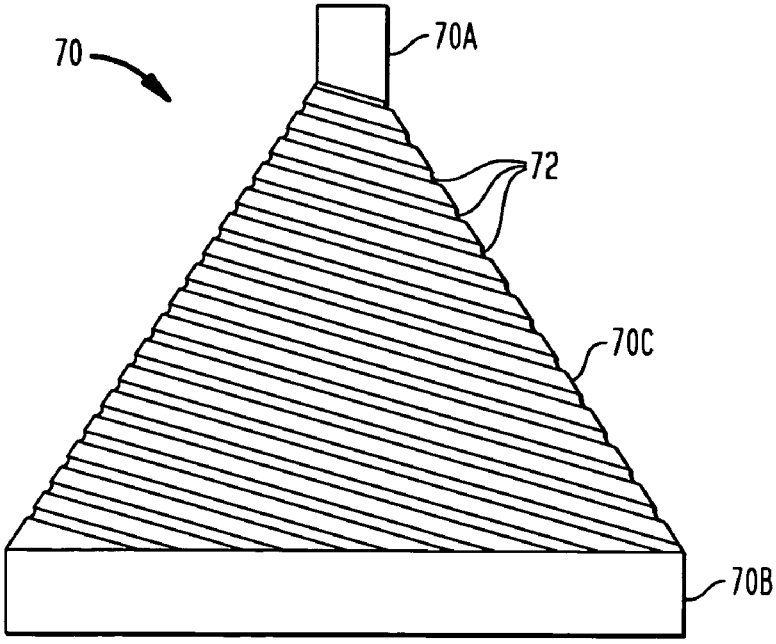
FIG. 4 is an isolated side view of an embodiment of a conically-shaped housing that can be used to support the coil system.

While the present invention has been described relative to the essential elements of the coil system, it may prove practical to provide a housing to support the coil system. The housing can protect the various coils/conductors, maintain electrical insulation between conductors, and maintain the shape of conical region 30. By way of example, one such housing is illustrated in FIG. 4 and is referenced generally by numeral 70.

Housing 70 is generally made of an electrically insulating material such as a ceramic material. Housing 70 is generally conical in shape. More specifically, in the illustrated example, housing 70 has axially aligned small and large annular regions 70A and 70B with a conically-shaped region 70C located therebetween. Housing 70 is hollow and is open at either end so that (i) gas can be injected into small annular region 70A, and (ii) a plasmoid can be generated in conically-shaped region 70C and expelled through large annular region 70B. Small annular region 70A will support windings of the force field coil (i.e., field coil 22) while large annular region 70B supports windings of the aft field coil (i.e., field coil 26). Conically-shaped region 70C has evenly-spaced parallel grooves 72 formed therein that helically wrap around region 70C. Each of grooves 72 has one of conductors 24A or 28A (not shown for clarity of illustration) fitted therein. Thus, grooves 72 define the helical windings of conductors 24A and 28A.

The advantages of the present invention are numerous. The multi-conductor, multi-turn coil system using interleaved and separately energized bias and drive coils provides a new level of efficiency for plasmoid thrusters. By providing for separate activation, the drive coil can be switched on at the peak of the bias field to insure optimum plasmoid formation. By connecting the fore and aft field coils in series with the coil system's bias coil, the field coils will slow down the bias discharge and introduce an inflection point in the bias field to define field line reconnection points when the drive field is introduced. Note that the fore and aft field coils can be wound in a reverse direction relative to the bias coil in order to enhance this effect.

Another advantage of the present invention is that virtually any gas can be used as a "propellant" since there are no electrodes that will corrode. Thus, the only limitation is that the gas be capable of being ionized using an appropriate preionizer coil. This means that the use of in-situ gas resources (e.g., gas derived from waste water, cryogenic boil-off, mined resources, etc.) can be used as a propellant. The parameters of the electrical currents affecting drive and bias values can be readily adjusted to enable peak efficiency and performance for use with various gases and to optimize the specific impulse for given mission requirements.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A coil system for a plasmoid thruster, comprising:

a bias coil defined by a first plurality of conductors positioned parallel to one another and helically wound about a conical region, said first plurality of conductors connected to one another in a parallel configuration;

a drive coil defined by a second plurality of conductors positioned parallel to one another, interleaved with said first plurality of conductors, and helically wound about said conical region, said second plurality of connected to one another in a parallel configuration;

a first field coil (i) defining a first passage at one end of said conical region, and (ii) connected in series with said bias coil; and a second field coil (i) defining a second passage at an opposing end of said conical region, and (ii) connected in series with said bias coil.

2. A coil system as in claim 1 wherein said one end of said conical region is smaller in diameter than said opposing end of said conical region, said coil system further comprising a preionizer coil positioned in said conical region adjacent said one end, said preionizer coil defining a third passage therethrough aligned with said first passage.

3. A coil system as in claim 1 further comprising means for supplying voltage independently to (i) a first circuit that includes a series combination of said first field coil, said bias coil and said second field coil, and (ii) a second circuit that includes said drive coil.

4. A coil system as in claim 1 further comprising a conically-shaped housing defining said conical region and supporting at least said bias coil and said drive coil.

5. A coil system as in claim 4 wherein said housing comprises an electrically insulating material.

6. A coil system as in claim 4 wherein said housing comprises a ceramic material.

7. A coil system as in claim 4 wherein said housing has parallel grooves formed therein and wrapped thereabout in a helical fashion with each of said grooves having one of said first plurality of conductors or one of said second plurality of conductors fitted therein.

8. A coil system for a plasmoid thruster, comprising:

a biasing circuit that includes a first field coil defining a first passage therethrough, a second field coil defining a second passage therethrough larger than said first passage and coaxially aligned therewith, and a biasing coil defined by N parallel conductors helically wound about a conical region between said first field coil and said second field coil, said N parallel conductors having N ends terminating at each axial end of said conical region with said N ends at each said axial end being electrically coupled to one another, said biasing circuit being formed by a series combination of said first field coil, said biasing coil, and said second field coil; and a drive circuit that includes M parallel conductors helically wound about said conical region and interleaved with said N parallel conductors, said M parallel conductors having M ends terminating at each said axial end of said conical region with said M ends at each said axial end being electrically coupled to one another.

9. A coil system as in claim 8 wherein N=M.

10. A coil system as in claim 8 wherein said N parallel conductors interleaved with said M parallel conductors comprise (N+M) evenly-spaced parallel conductors.

11. A coil system as in claim 8 further comprising a preionizer coil positioned in said conical region at one said axial end thereof.

12. A coil system as in claim 8 further comprising:

first voltage supply means completing said biasing circuit; and second voltage supply means completing said drive circuit.

13. A coil system as in claim 8 further comprising a conically-shaped housing defining said conical region and supporting said first field coil, said N parallel conductors, said M parallel conductors, and said second field coil.

14. A coil system as in claim 13 wherein said housing comprises an electrically insulating material.

15. A coil system as in claim 13 wherein said housing comprises a ceramic material.

16. A coil system as in claim 13 wherein said housing has parallel grooves formed therein and wrapped thereabout in a helical fashion with each of said grooves having one of said N parallel conductors or one of said M parallel conductors fitted therein.

17. A coil system for a plasmoid thruster, comprising:

means for defining a conical region open at first and second axial ends thereof;

a biasing circuit that includes a first field coil defining a first passage therethrough and positioned adjacent to said first axial end of said conical region, a second field coil defining a second passage therethrough larger than said first passage and positioned adjacent to said second axial end of said conical region wherein said first field coil is axially aligned with said second field coil, and a biasing coil defined by N parallel conductors helically wound about said means, said N parallel conductors having N ends terminating at each of said first axial end of said conical region and said second axial end of said conical region with said N ends at each of said first axial end and said second axial end being electrically coupled to one another, said biasing circuit being formed by a series combination of said first field coil, said biasing coil, and said second field coil; and a drive circuit that includes M parallel conductors helically wound about said means and interleaved with said N parallel conductors, said M parallel conductors having M ends terminating at each of said first axial end of said conical region and said second axial end of said conical region with said M ends at each of said first axial end and said second axial end being electrically coupled to one another.

18. A coil system as in claim 17 wherein N=M.

19. A coil system as in claim 17 wherein said N parallel conductors interleaved with said M parallel conductors comprise (N+M) evenly-spaced parallel conductors.

20. A coil system as in claim 17 further comprising a preionizer coil positioned in said conical region at said first axial end thereof.

21. A coil system as in claim 17 further comprising:

first voltage supply means completing said biasing circuit; and second voltage supply means completing said drive circuit.

22. A coil system as in claim 17 wherein said means comprises an electrically insulating material.

23. A coil system as in claim 17 wherein said means comprises a ceramic material.

24. A coil system as in claim 17 wherein said means has parallel grooves formed therein and wrapped thereabout in a helical fashion with each of said grooves having one of said N parallel conductors or one of said M parallel conductors fitted therein.

* * * * *